US007549621B2

(12) United States Patent
Kotani

(10) Patent No.: US 7,549,621 B2
(45) Date of Patent: Jun. 23, 2009

(54) SHEET POST-PROCESSING APPARATUS

(75) Inventor: Takashi Kotani, Osaka (JP)

(73) Assignee: Kyocera Mita Corporation (JP)

( * ) Notice: Subject to any disclaimer, the term of this patent is extended or adjusted under 35 U.S.C. 154(b) by 270 days.

(21) Appl. No.: 11/324,927

(22) Filed: Jan. 4, 2006

(65) Prior Publication Data

US 2006/0145408 A1 Jul. 6, 2006

(30) Foreign Application Priority Data

Jan. 5, 2005 (JP) ..... 2005-001000

(51) Int. Cl.
*B65H 39/00* (2006.01)

(52) U.S. Cl. ..... 270/58.13; 270/58.02; 270/58.08; 270/58.14; 270/58.15; 270/58.19; 270/58.28

(58) Field of Classification Search ..... 270/58.02, 270/58.08, 58.13, 58.14, 58.15, 58.19, 58.28
See application file for complete search history.

(56) References Cited

U.S. PATENT DOCUMENTS 5,350,169 A * 9/1994 Hiroi et al. ..... 271/213
5,497,984 A * 3/1996 Murakami et al. ..... 270/58.02
6,322,070 B2 * 11/2001 Yamada et al. ..... 271/293
6,494,449 B2 * 12/2002 Tamura et al. ..... 271/214
6,601,846 B2 * 8/2003 Saito et al. ..... 271/226
6,631,896 B2 * 10/2003 Yamada et al. ..... 270/58.09
6,986,511 B2 * 1/2006 Yamada et al. ..... 271/294
7,090,213 B2 * 8/2006 Suzuki et al. ..... 270/58.11
2002/0135119 A1 * 9/2002 Suzuki et al. ..... 271/3.01

FOREIGN PATENT DOCUMENTS

JP 7-53115 2/1995
JP 08198477 A * 8/1996
JP 9-263355 10/1997
JP 2002-68553 3/2002

* cited by examiner

*Primary Examiner*—Gene Crawford
*Assistant Examiner*—Leslie A Nicholson, III
(74) *Attorney, Agent, or Firm*—Gerald E. Hespos; Anthony J. Casella

(57) ABSTRACT

A sheet post-processing apparatus is constructed to apply post-processing to sheets successively supplied from an image forming apparatus and received into an apparatus main body, and includes a main discharge tray onto which the sheets that have passed through the apparatus main body are discharged. The sheet post-processing apparatus further has an elevating mechanism for moving the main discharge tray up and down and a control unit for controlling an elevation control of the elevating mechanism. The control unit controls the elevating mechanism to move the main discharge tray up and down in synchronism with the discharge of the sheet onto the main discharge tray. The control unit carries out the elevation control of the main discharge tray so as not to adversely affect the discharge of a succeeding sheet even if the sheet discharged from the apparatus main body is curled up or down.

10 Claims, 5 Drawing Sheets

SHEET POST-PROCESSING APPARATUS

BACKGROUND OF THE INVENTION

1. Field of the Invention

The present invention relates to a sheet post-processing apparatus for applying a specified post-processing to sheets fed from an upstream apparatus such as an image forming apparatus and discharging the post-processed sheets to a discharge tray.

2. Description of the Related Art

There has been adopted a sheet post-processing apparatus for automatically applying a specified post-processing such as punching and stapling to sheets discharged from an upstream apparatus such as an image forming apparatus. In the case of using such a sheet post-processing apparatus together with the upstream apparatus, the sheet post-processing apparatus is normally united with the upstream apparatus into an integral unit while being closely attached to the upstream apparatus. Accordingly, the sheets conveyed from the upstream apparatus are generally discharged onto a discharge tray provided in the sheet post-processing apparatus after passing the inside of the sheet post-processing apparatus regardless of whether or not they are to be post-processed. Such a sheet post-processing apparatus is known from Japanese Unexamined Patent Publication Nos. H07-53115, H09-263355 and 2002-68553.

The sheet post-processing apparatus disclosed in Japanese Unexamined Patent Publication No. H07-53115 is constructed such that an angle of inclination of the discharge tray provided in the sheet post-processing apparatus is made variable depending on whether or not the sheets conveyed from the upstream apparatus are to be post-processed, thereby changing an installation angle of the discharge tray depending on whether the sheets are discharged without having any post-processing applied thereto or they are discharge after having no post-processing applied thereto. Such an arrangement is made because a sheet discharge opening in the case of applying the post-processing to the sheets and the one in the case of applying no post-processing are provided at different positions, and the angle of inclination of the discharge tray is made variable so as to conform to both sheet discharge openings.

The sheet post-processing apparatus disclosed in Japanese Unexamined Patent Publication No. H09-263355 is constructed such that, upon an abnormality in a stacked state of sheets discharged from the sheet post-processing toward the discharge tray, such an abnormality is detected and the discharge tray is moved downward or upward to solve the abnormality in the stacked state by this movement.

The sheet post-processing apparatus disclosed in Japanese Unexamined Patent Publication No. 2002-68553 is constructed such that whether or not an end portion of a sheet discharged from the sheet post-processing apparatus is turned up to have U-shaped curl is detected, and the height position of the discharge tray is lowered to avoid the interference with a succeeding sheet.

However, since the angle of the discharge tray is merely changed depending on whether or not any post-processing is to be applied to the sheets in the sheet post-processing apparatus disclosed in Japanese Unexamined Patent Publication No. H07-53115, there is a problem that the sheet discharge cannot be properly performed due to the interference of the curl with the succeeding sheet if the sheet is curled.

Further, since the discharge tray is moved upward or downward after detecting the abnormal discharge of the sheets in the sheet post-processing apparatus disclosed in Japanese Unexamined Patent Publication No. H09-263355, only a measure against the already occurred abnormality is given upon an abnormal sheet discharge, for example, resulting from the curled sheet. Thus, there is a problem of being unable to prevent the sheet discharge abnormality.

In the sheet post-processing apparatus disclosed in Japanese Unexamined Patent Publication No. 2002-68553, the discharge tray is lowered to avoid the interference with the succeeding sheet if the sheet is curled upward to become U-shaped. Whether or not the sheet is curled is detected by a curl sensor. However, it is difficult to detect a slight curl formed at an end portion of the sheet by means of the curl sensor. Accordingly, there is a problem that the curled sheet may be handled as the one having no curl due to an erroneous detection of the curl sensor despite the actual presence of the curl.

SUMMARY OF THE INVENTION

In view of the problems residing in the prior art, an object of the present invention is to provide a sheet post-processing apparatus which can securely prevent the discharge of a succeeding sheet from being adversely affected even if a sheet discharged from an apparatus main body is curled upward or downward.

According to an aspect of the invention, a sheet post-processing apparatus is adapted for applying a specified post-processing to sheets successively received from an upstream apparatus into an apparatus main body. The sheet post-processing apparatus comprises a discharge tray onto which the sheets having passed through the apparatus main body are discharged; an elevating mechanism for moving the discharge tray upward and downward; and a control unit for controlling upward and downward movements of the elevating mechanism. The discharge tray is movable upward and downward between a specified home position and an upper position located above the home position; and the control unit controls the elevating mechanism to move the discharge tray upward and downward in synchronism with the sheet discharge onto the discharge tray. The discharge tray is caused to move from the home position to the upper position in synchronism with an arrival timing of the leading end of the sheet being discharged at the discharge tray while being caused to return to the home position in synchronism with an arrival timing of the trailing end of the discharged sheet at the discharge tray.

With this construction, the sheet discharged from the apparatus main body is received onto the discharge tray in synchronism with the sheet discharge by the control of the control unit. Thus, by setting the upward and downward moving states of the discharge tray in conformity with the kinds of the curls of the sheets and in order to avoid the interference with the succeeding sheet, the already discharged sheets and the sheet being discharged are both vertically shaken while the interference of the preceding sheet having been already discharged and the succeeding sheet is avoided, every time the sheet is discharged from the apparatus main body. Therefore, the bundle of the sheets on the discharge tray can be properly aligned.

When the downward curled sheet is discharged from the apparatus main body, the discharge tray is moved upward from the home position to the upper position, whereby the leading end of the downward curled discharged sheet comes into contact with the upper surface of the discharge tray (or comes into contact with the upper surface of the sheet discharged prior thereto if the preceding sheet was already discharged onto the discharge tray). Therefore, the downward curled discharged sheet can be prevented from rolling up due to a large drop and can be properly discharged onto the discharge tray.

Further, since the discharge tray is lowered to the initial home position until the trailing end of the sheet being discharged reaches the discharge tray, the sheets are shaken downward by this downward movement, whereby the sheets already discharged onto the discharge tray and the sheet being currently discharged can be aligned. This construction is suitably applicable particularly to downward curled sheets.

According to another aspect of the invention, a sheet post-processing apparatus is adapted for applying a specified post-processing to sheets successively received from an upstream apparatus into an apparatus main body, and comprising a discharge tray onto which the sheets having passed through the apparatus main body are discharged; an elevating mechanism for moving the discharge tray upward and downward; and a control unit for controlling upward and downward movements of the elevating mechanism, wherein the discharge tray is movable upward and downward between a specified home position, an upper position located above the home position, and a lower position located below the home position; and the control unit controls the elevating mechanism to move the discharge tray upward and downward in synchronism with the sheet discharge onto the discharge tray, wherein, for upward curled sheets having front and rear ends curved upward, the discharge tray is moved from the home position to the upper position in synchronism with an arrival timing of the leading end of the sheet being discharged at the discharge tray, moved to the lower position in synchronism with an arrival timing of the trailing end of the discharged sheet at the discharge tray, and is returned to the home position after the trailing end of the sheet reaches the discharge tray and the discharge of the succeeding sheet is started.

With this construction, the discharge tray is moved from the specified home position to the upper position in synchronism with the arrival timing of the leading end of the sheet being discharged at the discharge tray when the upward curled sheet is discharged from the apparatus main body. Thus, there can be prevented an occurrence of such an inconvenience that the trailing end of the discharged sheet leans against the wall surface between a sheet discharge opening and the discharge tray, and be consequently buckled. Since the discharge tray is lowered to the lower position below the home position in synchronism with the arrival timing of the trailing end of the discharged sheet at the discharge tray, thereby distancing the trailing end of the discharged sheet from the sheet discharge opening. Thus, the interference of the upward curl of the trailing end of the already discharged sheet with the succeeding sheet can be avoided.

The sheets are shaken upward and downward by such upward and downward movements, whereby the bundle of the sheets already discharged onto the discharge tray and the sheet being currently discharged can be aligned on the discharge tray. This construction is suitably applicable particularly to upward curled sheets.

These and other objects, features, aspects and advantages of the present invention will become more apparent upon a reading of the following detailed description and accompanying drawings.

BRIEF DESCRIPTION OF THE DRAWINGS

FIGS. 3A to 3D are diagrams showing an elevation control of a main discharge tray in the case where a sheet is curled downward (first embodiment), wherein FIG. 3A shows a state where the main discharge tray is set at a home position, FIG. 3B shows a state where the sheet discharge toward the main discharge tray set at an upper position is started, FIG. 3C shows a state where the sheet is discharged onto the main discharge tray set at the upper position and FIG. 3D shows a state where the main discharge tray is returned to the initial home position.

FIGS. 4A to 4D are diagrams showing an elevation control of the main discharge tray in the case where a sheet is curled upward (second embodiment), wherein FIG. 4A shows a state where the main discharge tray is set at the home position, FIG. 4B shows a state where the sheet is discharged toward the main discharge tray set at the upper position, FIG. 4C shows a state where a succeeding sheet is discharged onto the main discharge tray set at a lower position, and FIG. 4D shows a state where the succeeding sheet is being discharged onto the main discharge tray set at the upper position.

FIGS. 5A and 5B are diagrams showing an embodiment in which a sheet pressing member is provided below a sheet discharge opening of an apparatus main body, wherein FIG. 5A shows a state where the sheet pressing member is set in a pressing posture and FIG. 5B shows a state where the sheet pressing member is set in a releasing posture.

DETAILED DESCRIPTION OF THE PREFERRED EMBODIMENTS

Figure 1:
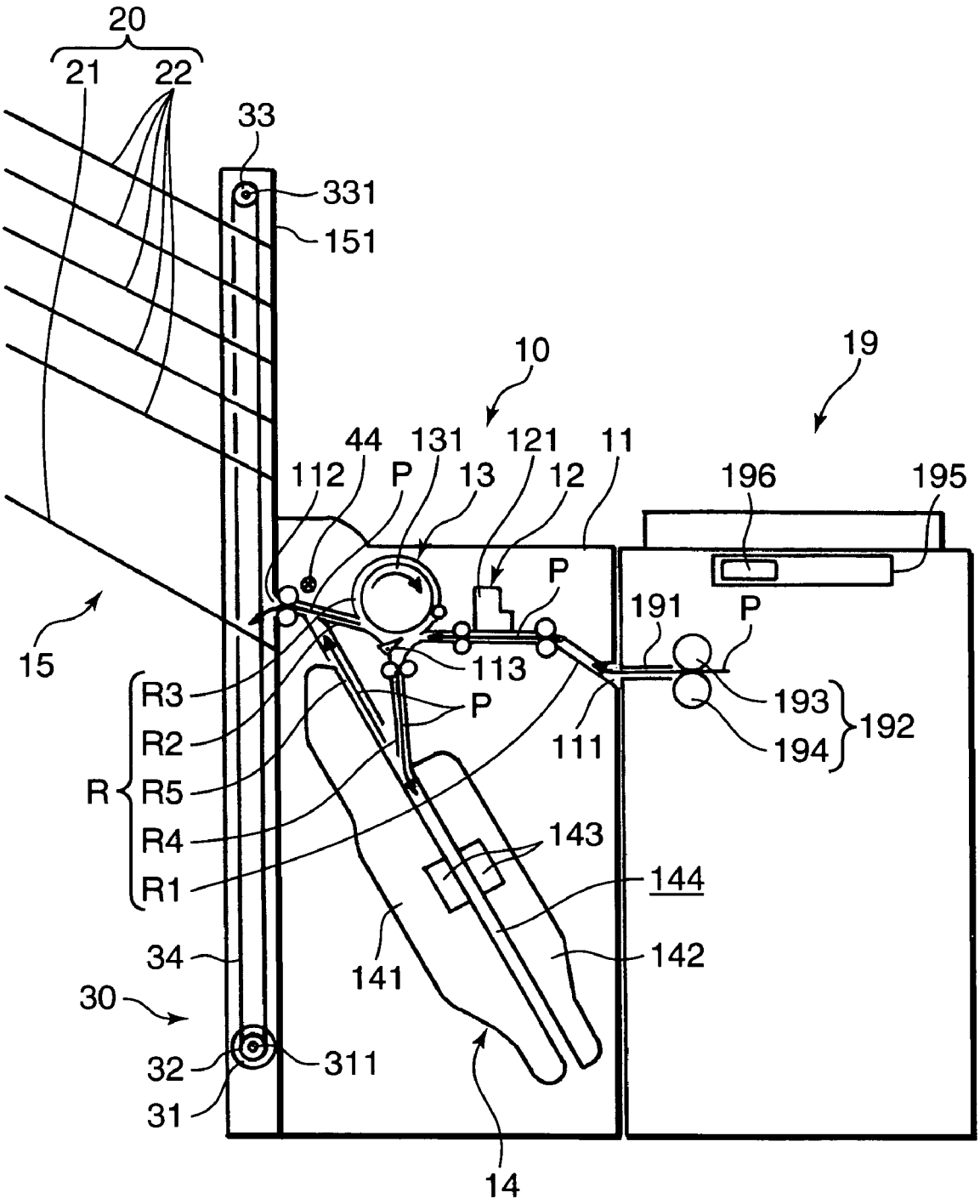
FIG. 1 is a front view in section outlining the internal construction of a sheet post-processing apparatus according to an embodiment of the present invention.

FIG. 1 is a front view in section outlining the inner construction of a sheet post-processing apparatus according to the present invention. As shown in FIG. 1, a sheet post-processing apparatus 10 is attached to a side surface of an image forming apparatus (upstream apparatus) 19 at a downstream side, and applies a specified post-processing to sheet(s) P supplied form the image forming apparatus 19. A punch unit 12, a sheet saving unit 13 and a staple unit 14 are provided in a box-shaped apparatus main body 11, and a sheet discharge unit 15 is provided outside the apparatus main body 11.

A sheet feed opening 111 facing a sheet discharge opening 191 of the image forming apparatus 19 is formed in a wall surface of the apparatus main body 11 opposed to the image forming apparatus 19, and a sheet discharge opening 112 is formed at an upper part of a wall surface opposed to the sheet discharge unit 15. A sheet P introduced into the apparatus main body 11 through the sheet feed opening 111 is discharged to the outside via the sheet discharge opening 112 through a specified conveyance path R. Conveyance rollers are provided at specified positions of the conveyance path R, wherein the sheet P is conveyed along the conveyance path R by driving these conveyance rollers.

In this embodiment, the conveyance path R is comprised of an entrance-side conveyance path R1 extending from the sheet feed opening 111 to the sheet saving unit 13 via the punch unit 12; an exit-side conveyance path R2 extending from the sheet saving unit 13 to the sheet discharge opening 112; an annular conveyance path R3 extending around the sheet saving unit 13; an intermediate conveyance path R4 extending from a downstream end of the entrance-side conveyance path R1 to the staple unit 14; and a sheet bundle discharge conveyance path R5 extending from the staple unit 14 to the sheet discharge opening 112.

The punch unit 12 is for perforating a punch hole as a binding hole in the sheet P introduced from the image forming apparatus 19 to the entrance-side conveyance path R1 via the sheet feed opening 111, and a specified punching machine 121 is provided here. The sheet P introduced to the punch unit 12 has a punch hole perforated by upward and downward movements of a punching rod of the punching machine 121 while being temporarily stopped.

The sheet saving unit 13 is for temporarily saving a specified number of sheets for timing adjustment upon successively supplying the sheets P conveyed along the entrance-side conveyance path R1 to the staple unit 14 at specified time intervals. In the sheet saving unit 13 is provided a cylindrical temporarily storing drum 131. The annular conveyance path R3 is defined on the circumferential surface of this temporarily storing drum 131. Accordingly, the sheets P temporarily stored in the annular conveyance path R3 are supplied to the staple unit 14 in a preset state through the clockwise rotation of the temporarily storing drum 131 about its center axis, accompanying a sheet P conveyed next, by changing the posture of a switch guide 113 provided at a downstream end of the entrance-side conveyance path R1.

The staple unit 14 applies stapling to bind a specified number of sheets P introduced through the intermediate conveyance path R4. This staple unit 14 includes an intermediate tray 141 obliquely oriented from an upper left side to a lower right side in FIG. 1 in the apparatus main body 11, a covering member 142 covering the upper surface of the intermediate tray 141, and a stapler 143 disposed between the intermediate tray 141 and the covering member 142.

A sheet bundle storing space 144 for temporarily storing a sheet bundle comprised of a plurality of sheets P introduced through the intermediate conveyance path R4 during the stapling is defined between the intermediate tray 141 and the covering member 142. The stapler 143 applies stapling to the sheet bundle stored in such a sheet storing space 144. The stapled sheet bundle is discharged to the outside by way of the sheet discharge opening 112 through the sheet bundle discharge conveyance path R5.

The sheet discharge unit 15 is for receiving the sheet P discharged by way of the sheet discharge opening 112 of the apparatus main body 11 or the stapled sheet bundle, and is provided with discharge trays 20 disposed movably upward and downward between a pair of guiding columns 151 standing while being distanced in width direction (direction orthogonal to the plane of FIG. 1) and an elevating mechanism 30 for moving the discharge trays 20 upward and downward.

The discharge trays 20 include a main discharge tray 21, and a plurality of auxiliary discharge trays 22 disposed at positions above the main discharge tray 21. The main discharge tray 21 is used to normally discharge sheets, whereas the auxiliary discharge trays 22 are used to sort or to discharge sheets by the purpose.

The elevating mechanism 30 is for moving the discharge trays 20 and includes a drive motor 31 horizontally placed at a bottom position between the pair of guiding columns 151, a lower gear 32 concentrically and integrally fitted on a drive shaft 311 of the drive motor 31, an upper gear 33 rotatably supported on a horizontally extending driven shaft 331 disposed at an upper position between the guiding columns 151, and a timing belt 34 mounted between the lower gear 32 and the upper gear 33.

Any of the main discharge tray 21 and the auxiliary discharge trays 22 is coupled to either one of a forward belt and a returning belt of the timing belt 34, whereby the discharge trays 20 are moved upward and downward while being guided by the guiding columns 151 through the forward and reverse rotations of the timing belt 34 between the lower gear 32 and the upper gear 33 by driving the drive motor 31 in forward and reverse directions.

Since most of the sheets P fed from the image forming apparatus 19 are curled upward or downward at their end portions, the discharge trays 20 are made movable upward and downward in order to avoid the interference of the end portion of the sheet P on the discharge tray 20 and the succeeding sheet P from the image forming apparatus 19 due to these curls. Particularly in the case of using the auxiliary discharge tray 22, the one selected from a plurality of auxiliary discharge trays 22 needs to be opposed to the sheet discharge opening 112 and, therefore, this auxiliary discharge tray 22 is made movable upward and downward.

In the vicinity of the sheet discharge opening 112 of the sheet post-processing apparatus 10 constructed as above, a sheet sensor (leading and trailing end sensor) 44 is provided to detect the sheet P just before being discharged through the exit-side conveyance path R2. As this sheet sensor 44 is adopted a so-called optical sensor for emitting a light from a light source and detecting the presence of the sheet P by receiving a reflected light if the sheet P is present or conversely for detecting the absence of the sheet P by receiving a transmitted light if the sheet P is absent.

In the present invention, upon discharging the sheet P toward the discharge tray 20 through the sheet discharge opening 112 of the apparatus main body 11 utilizing the detection result of the sheet sensor 44 and the elevating mechanism 30, the sheet is properly discharged by moving the discharge tray 20 upward or downward by a control of a control unit depending on the curled state of the sheet P.

First, the curl of the sheet P is described. The image forming apparatus 19 as an upstream apparatus is such that an image data read by a scanning operation or a light signal based on an electrically transmitted image data is irradiated onto the circumferential surface of a photosensitive drum, thereby forming an electrostatic latent image on this circumferential surface that was uniformly charged. After a toner image is obtained by supplying toner to this electrostatic latent image, the toner image is transferred to the sheet P, the sheet P bearing the transferred image is successively fixed and then the sheet P is transferred to the sheet post-processing apparatus 10 through the sheet discharge opening 191 of the image forming apparatus 19.

The above fixing operation is performed by a fixing device 192 disposed at a downstream side (left side in FIG. 1) of the photosensitive drum. Specifically, the fixing device 192 includes a fixing roller 193 having a heating element provided inside and a pressure roller 194 arranged below the fixing roller 193 such that the circumferential surfaces of the two rollers 193, 194 are in contact. The sheet P bearing the toner image transferred from the photosensitive drum passes a nip between the fixing roller 193 and the pressure roller 194 while being tightly sandwiched, thereby receiving heat from the fixing roller 193 to fix the toner image.

If the sheet P is a normal copy sheet, the sheet P having the toner image fixed thereto and having left the nip of the fixing device 192 is curled downward in such a manner that front and rear ends of the sheet P are curved downward due to a thermal expansion on the front surface of the sheet P larger than the one on the rear surface because the fixing roller 193 has a higher temperature than the pressure roller 194.

Contrary to this, if the sheet P is a thin sheet or a normal copy sheet having both surfaces printed, an amount of heat supplied from the fixing roller 193 to the sheet p becomes excessive and the toner on the sheet P is excessively melted (because the sheet P has a small volume and a smaller thermal capacity as a whole as compared to normal sheets if it is thin, wherefore temperature is likely to rise, whereas the sheet P already curled downward is supplied to the fixing roller 193 to wind around the fixing roller 193 while being conversely curled upward if the sheet P has both surfaces printed). The excessively melted toner sticks to the circumferential surface of the fixing roller 193 and the sheet P winds around the fixing roller 193, wherefore the sheet P is curled upward by having the front and rear ends curved upward.

Such a curled sheet P may not be properly discharged from the apparatus main body 11 due to this curl. Accordingly, in the present invention, the discharge trays 20 are moved upward and downward depending on whether the curl of the sheet P is a downward curl or an upward curl, whereby the sheet P can be properly discharged by the control of a control unit 40 even if being curled.

Figure 2:
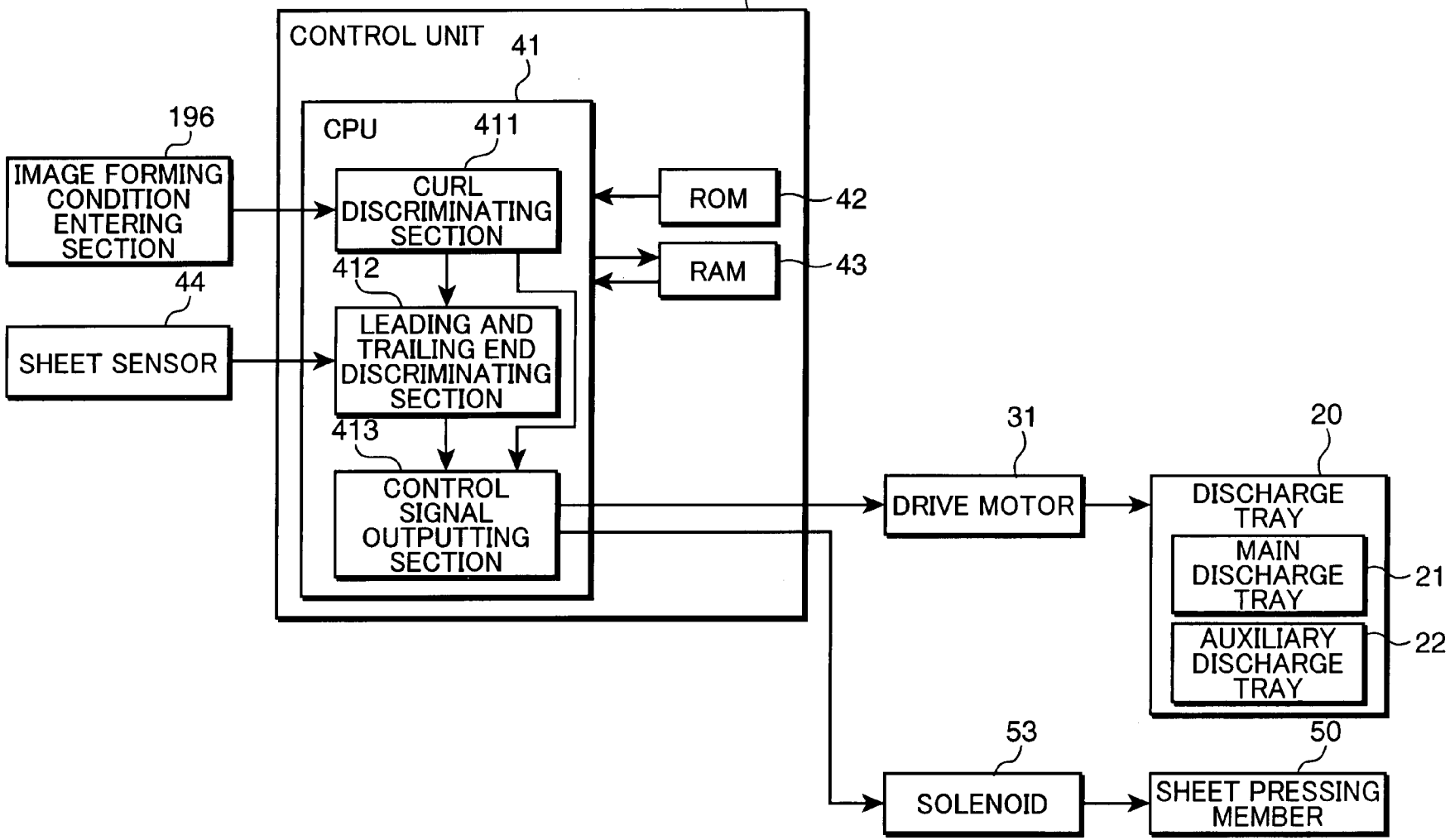
FIG. 2 is a block diagram showing one embodiment of a sheet discharge control by a control unit.

The elevation control of the main discharge tray 21 is described with reference to FIG. 2. FIG. 2 is a block diagram showing one embodiment of a sheet discharge control by the control unit 40. As shown in FIG. 2, the control unit 40 is a microcomputer disposed at a specified position in the apparatus main body 11, and has a basic construction comprised of a CPU (central processing unit) 41 as central calculating means, a ROM (read only memory) 42 as a storage device exclusively used for reading and attached to the CPU 41, and a RAM (random access memory) 43 as a readable/writable storage device attached to the CPU 41.

A program for the elevation control of the main discharge tray 21 and data as judgment standards are stored in the ROM 42, whereas data temporarily obtained by the calculation of the CPU 41 and the like are readably and writably stored in the RAM 43.

The CPU 41 includes a curl discriminating section 411 for discriminating whether the sheet P being discharged toward the main discharge tray 21 is curled downward or upward, a leading and trailing end discriminating section 412 to which a detection signal from the sheet sensor 44 is inputted and which discriminates the leading end and the trailing end of the sheet P being discharged through the sheet discharge opening 112 based on this detection signal, and a control signal outputting section 413 for outputting a control signal to the drive motor 31 based on the discrimination results of the curl discriminating section 411 and the leading and trailing end discriminating section 412.

The curl discriminating section 411 discriminates whether the sheet P being fed from the image forming apparatus 19 is curled downward or upward in accordance with information from the image forming apparatus 19. To this end, an operation panel 195 of the image forming apparatus 19 is provided with an image forming condition entering section 196 for entering the kind of the sheet P (normal sheet (plain paper) or thin sheet (thin paper) to have an image transferred thereto and a printing method (single-side printing or duplex printing). The kind of the sheet and the printing method entered by means of the image forming condition entering section 196 are inputted to the curl discriminating section 411.

The curl discriminating section 411 discriminates whether the sheet P is curled downward or upward in accordance with the information inputted from the image forming condition entering section 196, and outputs the discrimination result to the control signal outputting section 413. Specifically, the curl discriminating section 411 judges that the sheet P being fed from the image forming apparatus 19 is curled downward if the sheet P is a normal paper and has one surface printed while judging that the sheet P being fed from the image forming apparatus 19 is curled upward if the sheet P is a thin paper or a plain paper having both surfaces printed.

Since the curl discriminating section 411 obtains the curled state of the sheet P from the information inputted from the image forming condition entering section 196 in this way, there is no likelihood of such an inconvenience as to perform a wrong operation upon an error detection as compared to a conventional method for detecting the curl of the sheet P by a specified sensor.

The leading and trailing end discriminating section 412 discriminates an arrival timing of the leading end of the sheet P being discharged through the exit-side conveyance path R2 at the main discharge tray 21 and a discharge timing of the trailing end of the sheet P onto the main discharge tray 21 based on the detection result inputted from the sheet sensor 44. The arrival timing of the leading end of the sheet P at the main discharge tray 21 is discriminated by adding a specified period of time set beforehand to the detection timing of the sheet P by the sheet sensor 44, whereas the discharge timing of the trailing end of the sheet P onto the main discharge tray 21 is discriminated by adding a specified period of time set beforehand to a timing, from which on the sheet sensor 44 has not detected the sheet P. The control unit 40 is provided with an unillustrated timer in order to make such discriminations, and the control signal outputting section 413 calculates discharge timings of the leading and trailing ends of the sheet P by adding time information obtained from this timer to the detection timings by the sheet sensor 44.

The discrimination result of the leading and trailing end discriminating section 412 (i.e. arrival of a specified timing just before the arrival of the leading end of the sheet P at the main discharge tray 21 and arrival of a specified timing just before the arrival of the trailing end of the sheet P at the main discharge tray 21) is immediately outputted as a command signal to the control signal outputting section 413.

The control signal outputting section 413 outputs a control signal to the drive motor 31 based on the received discrimination result of the curl discriminating section 411 and the received discrimination result of the leading and trailing end discriminating section 412, thereby causing the main discharge tray 21 to make a specified elevating movement between a home position H1 (see FIG. 3) set beforehand, an upper position H2 located above the home position H1, and a lower position H3 (see FIG. 4) located below the home position H1. This elevating movement differs depending on the sheet P is curled downward or upward.

Figure 3B:
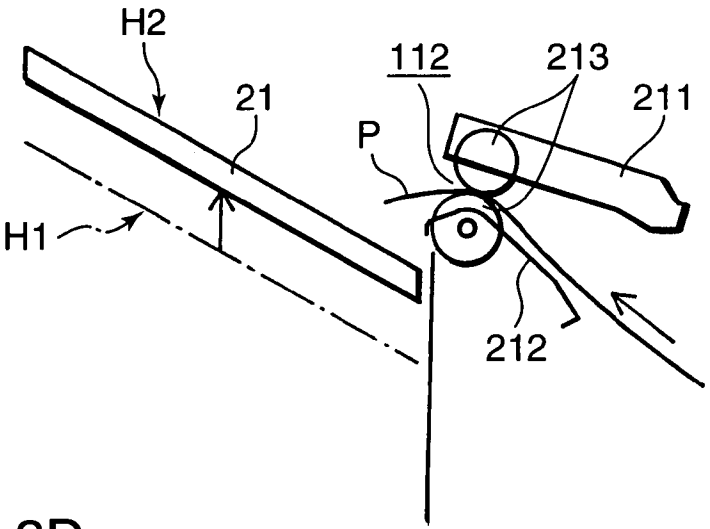
Figure 3D:
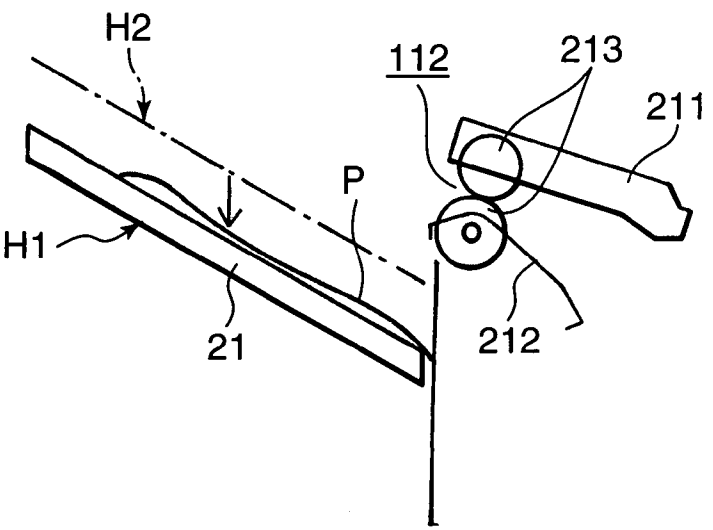
Figure 3A:
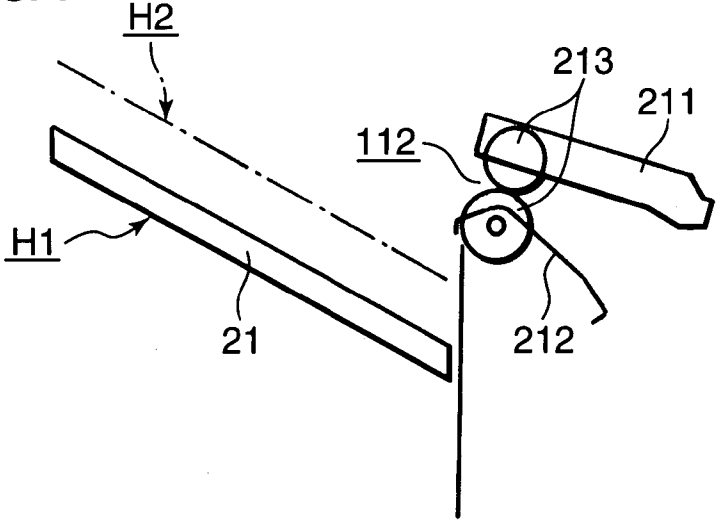
Figure 3C:
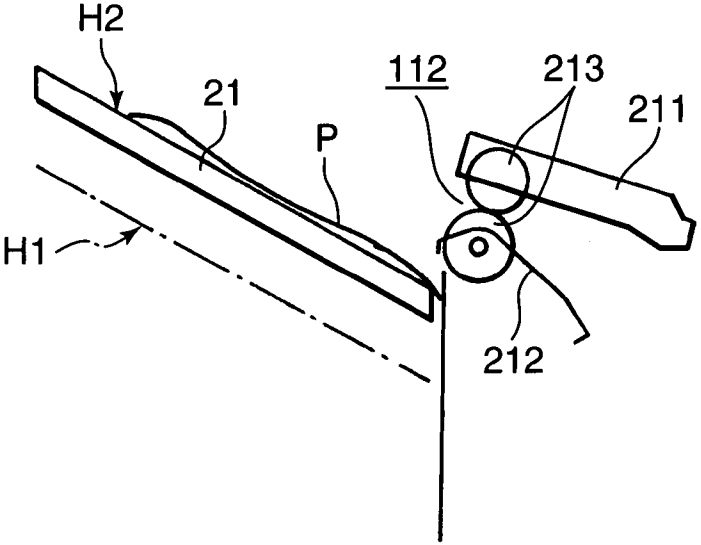

A case where the sheet P is curled downward is first described with reference to FIGS. 3A to 3D and, if necessary, to FIG. 2. FIGS. 3A to 3D are diagrams showing an elevation control of the main discharge tray 21 in the case where the sheet P is curled downward, wherein FIG. 3A shows a state where the main discharge tray 21 is set at the home position H1, FIG. 3B shows a state where the sheet discharge toward the main discharge tray 21 set at the upper position H2 is started, FIG. 3C shows a state where the sheet P is discharged onto the main discharge tray 21 set at the upper position H2 and FIG. 3D shows a state where the main discharge tray 21 is returned to the initial home position H1.

In the first embodiment, as shown in FIGS. 3A and 3B, the home position H1 and the upper position H2 located slightly above the home position H1 are set beforehand for the main discharge tray 21. With no sheet P discharged, the home position H1 is set at such a position where the uppermost sheet P is considerably lower than the sheet discharge opening 112 even if a preset number of sheets P are discharged and stacked on the main discharge tray 21. Such position setting is made in order to locate the bundle of the sheets P placed on the main discharge tray 21 below the sheet discharge opening 112 even if the main discharge tray 21 is raised to the upper position H2.

If the sheet P conveyed from the image forming apparatus 19 to the sheet post-processing apparatus 10 is discriminated to be curled downward by the curl discriminating section 411 and when the leading and trailing end discriminating portion 412 discriminates the leading end of the sheet P, the control signal outputting section 413 immediately outputs such a control signal as to move the main discharge tray 21 upward to the drive motor 31 upon receiving a command signal (upward command signal) from the leading and trailing end discriminating section 412. As a result, the main discharge tray 21 is moved up from the home position H1 shown in FIG. 3A to the upper position H2 shown in FIG. 3B.

The sheet P having arrived at the nip between a pair of upper and lower discharge rollers 213 via an upper discharge guide and a lower discharge guide 212 at this time is discharged onto the main discharge tray 21 as shown in FIG. 3C by driving the discharge rollers 213. Upon this discharge, since the main discharge tray 21 is set at the upper position H2 close to the sheet discharge opening 112, an occurrence of such an inconvenience that the leading end of the downward curled sheet P rolls up toward the wall surface of the apparatus main body 11 can be securely prevented even if the leading end of the sheet P is curled downward.

Subsequently, when the sheet P is discharged onto the main discharge tray 21 (this sheet discharge is recognized by the leading and trailing end discriminating section 412 upon the detection of the trailing end of the sheet P by the sheet sensor 44), the control signal outputting section 413 outputs such a control signal to lower the main discharge tray 21 toward the home position to the drive motor 31. Thus, the main discharge tray 21 is returned to the home position Hi by driving the drive motor 31 as shown in FIG. 3D.

A time schedules of control signals the control signal outputting section 413 outputs to the drive motor 31 after the detection of the leading end of the sheet P by the sheet sensor 44 and the issuance of the upward command signal from the leading and trailing end discriminating section 412 to the control signal outputting section 413 based on this detection result is stored in the ROM 42 beforehand in correspondence with the sizes of the sheets P, and the control signal outputting section 413 outputs a control signal to the drive motor 31 in accordance with this time schedule.

Every time the sheet P is discharged onto the main discharge tray 21, such a series of operations for the elevation control of the main discharge tray 21 are repeated, whereby the downward curled sheets P are constantly properly stacked on the main discharge tray 21. Further, the stacked sheets are vertically shaken by the upward and downward movements thereof to let air enters between the vertically adjacent sheets P, thereby making the sheets P more likely to slip relative to each other, thereby properly aligning the ends of the discharged sheets P.

Figure 4B:
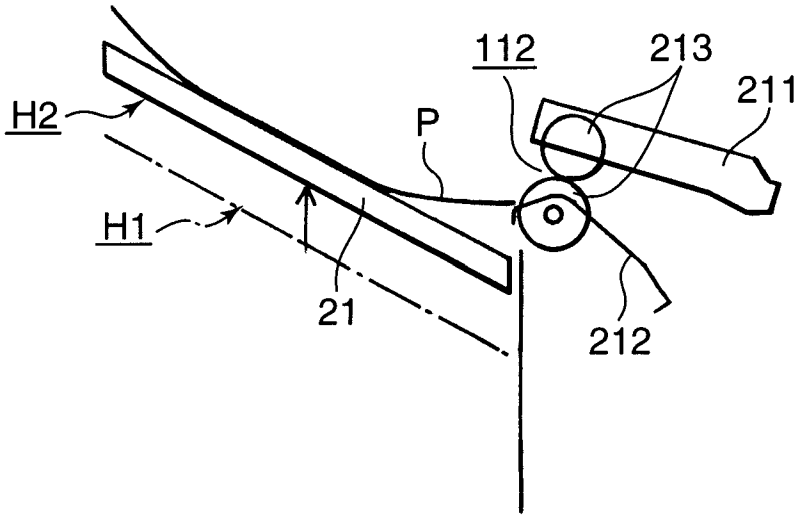
Figure 4D:
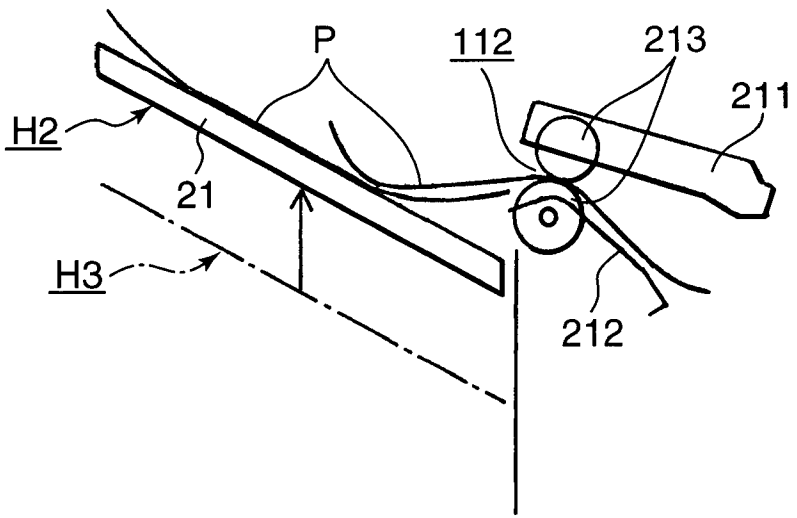
Figure 4A:
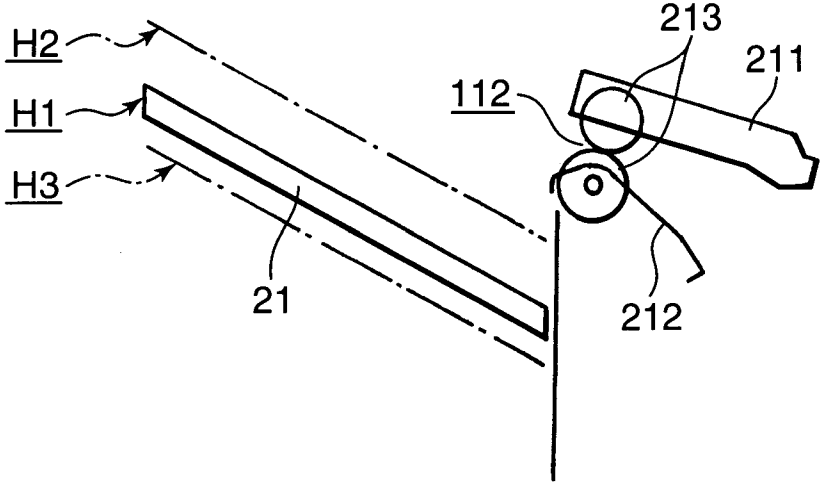
Figure 4C:
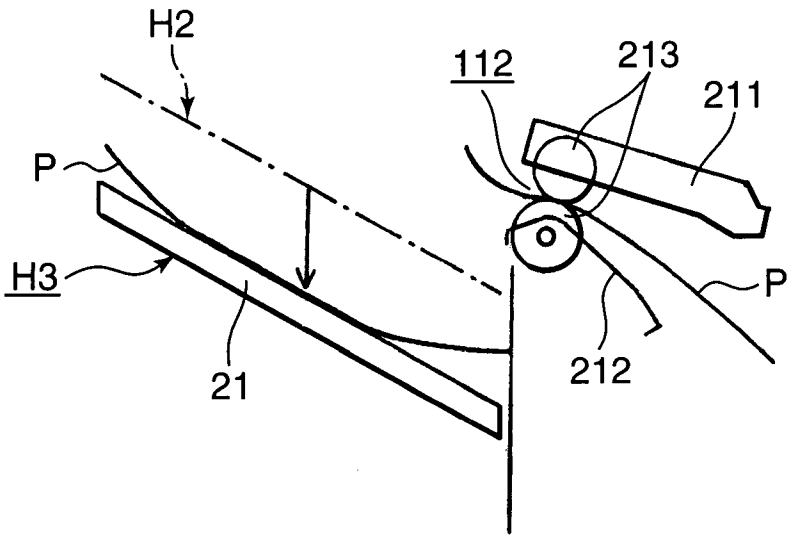

Next, a case where the sheet P is curled upward is described with reference to FIGS. 4A and 4D and, if necessary, to FIG. 2. FIGS. 4A to 4D are diagrams showing an elevation control of the main discharge tray 20 in the case where the sheet P is curled upward, wherein FIG. 4A shows a state where the main discharge tray 21 is set at the home position H1, FIG. 4B shows a state where the sheet P is discharged onto the main discharge tray 21 set at the upper position H2, FIG. 4C shows a state where a succeeding sheet P is discharged onto the main discharge tray 21 set at the lower position H2, and FIG. 4D shows a state where the succeeding sheet is being discharged onto the main discharge tray 20 set at an upper position H3.

The elevation control of the second embodiment for the main discharge tray 21 performed for the upward curled sheets P is similar to that of the first embodiment for the downward curled sheets P until the discharge of the first sheet P is completed (the sheet P is discharged onto the main discharge tray 21 (see FIG. 4B) in synchronism with the upward movement of the main discharge tray 21 set at the home position H1 as shown in FIG. 4A toward the upper position H2), but upward and downward movements of the main discharge tray 21 thereafter differ from those in the first embodiment.

Specifically, if the sheet P is curled upward, the upward curl of the trailing end of the sheet P is close to the discharge roller 213 at the sheet discharge opening 112 as shown in FIG. 4B with the sheet P discharged onto the main discharge tray 21 set at the upper position H2. Thus, the leading end of the succeeding sheet P interferes with the upward curl of the preceding sheet P when the succeeding sheet P is discharged, thereby slipping under the preceding sheet P or causing another inconvenience. Therefore, there is a likelihood of being unable to properly discharge the sheets. Such an inconvenience becomes noticeable when a plurality of sheets P are discharged onto the main discharge tray 21 to form a sheet bundle.

Accordingly, in the case of the upward curled sheets P, the control signal outputting section 413 outputs such a control signal to the drive motor 31 as to move the main discharge tray 21 from the present upper position H2 to the lower position H3 lower than the home position H1 in accordance with a downward command signal from the leading and trailing end discriminating section 412 after the detection of the leading end of the succeeding sheet P by the sheet sensor 44. Since the main discharge tray 21 is lowered from the upper position H2 to the lower position H3 as shown in FIG. 4C in accordance with this control signal, the trailing end of the sheet P present on the main discharge tray 21 is distanced downward from the sheet discharge opening 112, thereby avoiding the interference of the trailing end of the preceding sheet P with the leading end of the succeeding sheet P.

Subsequently, when the drive motor 31 is driven upon receiving the control signal from the control signal outputting section 413 in synchronism with the discharge of the succeeding sheet P, the main discharge tray 21 is raised toward the upper position H2 as shown in FIG. 4D. Since the succeeding sheet P is already placed on the preceding sheet P at this moment, the succeeding sheet P is discharged without being inteferred by the preceding sheet P.

Thereafter, until the last sheet P is discharged, the main discharge tray 21 is repeatedly moved downward and upward between the lower position H3 and the upper position H2 as described as the sheets P are discharged. After the last sheet P is discharged, the main discharge tray 21 is returned to the initial home position H1.

As descried above, in the elevation control of the main discharge tray 21 for the upward curled sheets P, the main discharge tray 21 is once lowered from the home position H1 to the lower position H3 below the home position H1 after the sheet P is discharged, thereby avoiding the interference of the upward curl of the trailing end of the preceding sheet P with the leading end of the succeeding sheet P. Thus, even if the sheets P should be considerably curled upward, a proper sheet discharge can be realized in such a state as not to cause inconveniences such as a disorder in page numbers.

Figure 5B:
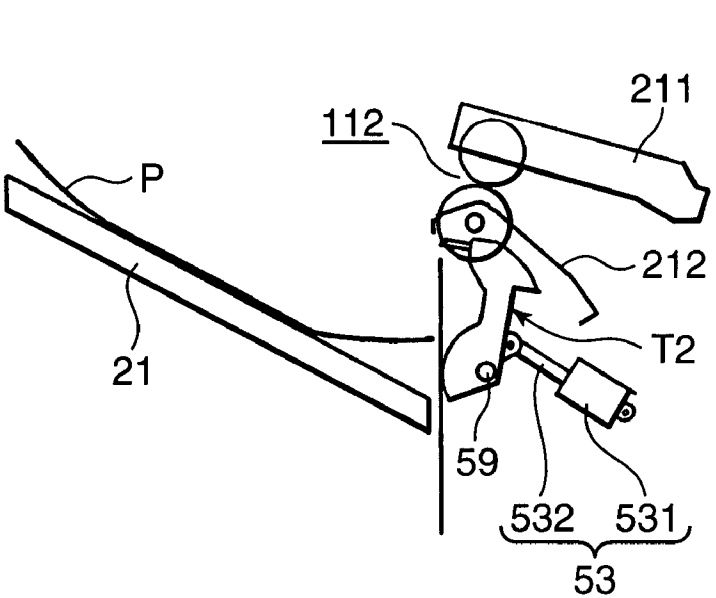
Figure 5A:
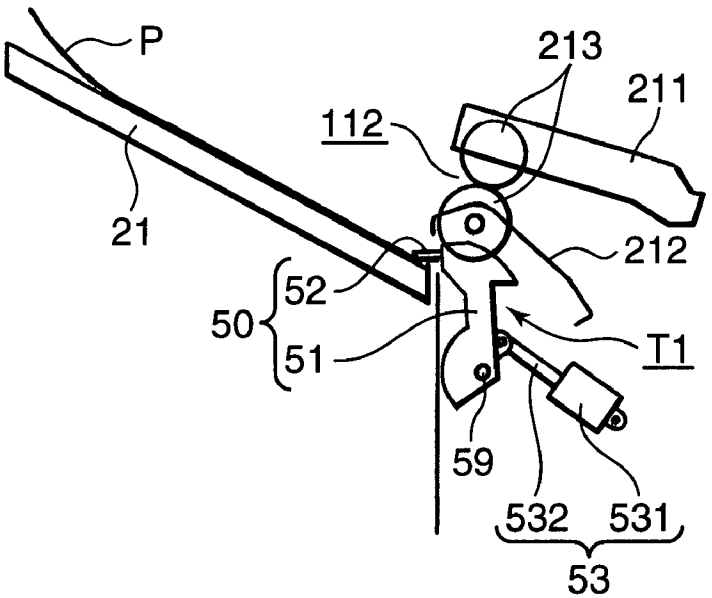

FIGS. 5A and 5B are diagrams showing an embodiment in which a sheet pressing member 50 is provided below the sheet discharge opening 112 of the apparatus main body 11, wherein FIG. 5A shows a state where the sheet pressing ember 50 is set in a pressing posture T1 and FIG. SB shows a state where the sheet pressing member 50 is set in a releasing posture T2. In this embodiment, the sheet pressing member 50 for pressing the upward curl of the trailing end of the sheet P discharged onto the main discharge tray 21 is disposed at a position immediately below the pair of discharge rollers 213.

The sheet pressing member 50 is rotatably supported on a supporting shaft 59 extending in a sheet width direction normal to a sheet conveying direction, and includes a pressing main portion 51 extending upward from the supporting shaft 59, and a pressing piece 52 projecting from the upper end of the pressing main portion 51 toward the main discharge tray 21 to press the sheet P. The pressing piece 52 is set at a position slightly above the rear end of the main discharge tray 21 with the main discharge tray 21 located at the upper position H2.

Such a sheet pressing member 50 is driven by an actuator (solenoid 53 in an example shown in FIG. 5) disposed behind (to the right in FIG. 5) the pressing main portion 51 to turn in forward or backward direction about the supporting shaft 59, whereby the pressing piece 52 can change its posture between the pressing posture T1 shown in FIG. 5A to press the upward curl of the trailing end of the sheet P on the main discharge tray 21 and the releasing posture T2 shown in FIG. 5B to be released from the sheet P.

The solenoid 53 is comprised of a solenoid main body 531 having an electromagnetic coil mounted therein, and an iron core 532 penetrating through the solenoid main body 531 and the electromagnetic coil therein. The iron core 532 is retracted into the solenoid main body 531 through the excitation of the electromagnetic coil by the supply of a current to set the sheet pressing member 50 in the releasing posture T2 (see FIG. 5B) while being caused to project from the solenoid main body 531 to set the sheet pressing member 50 in the pressing posture T1 (see FIG. 5A) when the supply of the current is stopped.

Such a sheet pressing member 50 is set in the pressing posture T1 where the pressing piece 52 projects out from the sheet discharge opening 112 to press the upward curl of the trailing end of the sheet P as shown in FIG. 5A with the main discharge tray 21 located at the upper position H2. On the other hand, with the main discharge tray 21 located at the lower position H3, the sheet pressing member 50 is kept in the releasing posture T2 where the pressing piece 52 is retracted into the apparatus main body 11 from the sheet discharge opening 112 as shown in FIG. 5B until the discharge of the succeeding sheet P onto the main discharge tray 21 is completed, and is returned to the pressing posture T1 in synchronism with the succeeding upward movement of the main discharge tray 21.

In order to change the posture of the sheet pressing member 50 between the pressing posture T1 and the releasing posture T2 in synchronism with the discharge of the sheet P and the upward and downward movements of the main discharge tray 21, the control signal outputting section 413 outputs a control signal to the solenoid 53 in accordance with the detection result of the sheet sensor 44. A resulting forward or reverse rotation of the iron core 532 of the solenoid 53 causes the posture of the sheet pressing member 50 to be changed between the pressing posture T1 and the releasing posture T2 in synchronism with the discharge of the sheet P and the succeeding upward movement of the main discharge tray 21.

By adopting the sheet pressing member 50 constructed as above, the elevation control of the main discharge tray 21 particularly according to the second embodiment in which the sheets P discharged through the sheet discharge opening 112 of the apparatus main body 11 are curled upward can be so carried out as to securely prevent the already discharged sheet P on the main discharge tray 21 from interfering with the sheet P discharged next. Thus, even if the bundle of the discharged sheets P on the main discharge tray 21 has a considerable thickness (specifically even if the upper rear end of the bundle of the sheets P is located above the sheet discharge opening 112 without the sheet pressing member 50 being provided), the sheets P can be properly discharged from the sheet discharge opening 112 without being interfered by the bundle of the sheets P on the main discharge tray 21.

As described in detail above, the sheet post-processing apparatus 10 of the present invention is constructed to be able to apply a specified post-processing to the sheets P successively supplied from the image forming apparatus 19 and received into the apparatus main body 11, and provided with the elevating mechanism 30 for elevating the main discharge tray 21 and the control unit 40 for controlling the upward and downward movements of the elevating mechanism 30 on the premise that the main discharge tray 21 is provided to discharge the sheets P having passed through the apparatus main body 11. Since the control unit 40 is so constructed as to control the elevating mechanism 30 to move the main discharge tray 21 upward and downward in synchronism with the discharge of the sheet P onto the main discharge tray 21, the sheet P discharged from the apparatus main body 11 is received onto the main discharge tray 21 moving upward and downward in synchronism with the discharge of the sheet P by the control of the control unit 40.

Accordingly, by setting the upward and downward moving states of the main discharge tray 21 in conformity with the kinds of the curls of the sheets P and in order to avoid the interference with the succeeding sheets P, the already discharged sheets P and the sheet P being discharged are both vertically shaken while the interference of the preceding sheet P having been already discharged and the succeeding sheet P is avoided, every time the sheet P is discharged from the apparatus main body 11. Thus, the bundle of the sheets P on the main discharge tray 21 can be properly aligned.

In the first embodiment, the main discharge tray 21 is constructed to be movable upward and downward between the specified home position H1 and the upper position H2 located above the home position H1; and the control unit 40 controls the elevating mechanism 30, for the downward curled sheets having front and rear ends curved downward, to move the main discharge tray 21 from the home position H1 to the upper position H2 until the leading end of the sheet P being discharged reaches the main discharge tray 21 while returning the main discharge tray 21 to the home position H1 until the trailing end of the sheet P having been just discharged reaches the main discharge tray 21. Thus, when the downward curled sheet P is discharged from the apparatus main body 11, the main discharge tray 21 is moved upward from the home position H1 to the upper position H2, whereby the leading end of the downward curled discharged sheet P comes into contact with the upper surface of the main discharge tray 21 (or comes into contact with the upper surface of the sheet P discharged prior thereto if the preceding sheet P was already discharged onto the main discharge tray 21). Consequently, the downward curled discharged sheet P is prevented from rolling up on the main discharge tray 21 due to a large drop of the leading end of the sheet P. Thus, the sheet P can be properly discharged onto the main discharge tray 21.

Further, since the main discharge tray 21 is lowered from the initial home position H1 until the trailing end of the sheet P being discharged reaches the main discharge tray 21, the sheets P are shaken downward by this downward movement of the main discharge tray 21, whereby the sheets P already discharged onto the main discharge tray 21 and the sheet P being currently discharged can be aligned.

In the second embodiment, the main discharge tray 21 is constructed to be movable upward and downward between the specified home position H1, the upper position H2 located above the home position H1 and the lower position below the home position H1; and the control unit 40 controls the elevating mechanism 30, for the upward curled sheets having front and rear ends curved upward, to move the main discharge tray 21 from the home position H1 to the upper position H2 until the leading end of the sheet P being discharged reaches the main discharge tray 21, to move the main discharge tray 21 to the lower position H3 until the trailing end of the sheet P having been just discharged reaches the main discharge tray 21, and to return the main discharge tray 21 to the upper position H2 after the trailing end of the sheet P reaches the main discharge tray 21 and the succeeding sheet P is discharged.

With such a construction, the main discharge tray 21 is moved form the specified home position H1 to the upper position H2 until the leading end of the sheet P being discharged reaches the main discharge tray 21 when the upward curled sheet P is discharged from the apparatus main body 11. Thus, there can be prevented an occurrence of such an inconvenience that the trailing end of the discharged sheet P leans against the wall surface between the sheet discharge opening 112 and the main discharge tray 21 to be buckled.

Further, the main discharge tray 21 is lowered to the lower position H3 below the home position H1 until the trailing end of the discharged sheet P reaches the main discharge tray 21, thereby distancing the trailing end of the discharged sheet P from the sheet discharge opening 112. Thus, the interference of the upward curl of the trailing end of the already discharged sheet P with the succeeding sheet P can be avoided.

The sheets P are shaken upward and downward by such upward and downward movements, whereby the bundle of the sheets P already discharged onto the main discharge tray 21 and the sheet P being currently discharged can be aligned on the main discharge tray 21.

Further, the sheet pressing member 50 for pressing the trailing end of the sheet P discharged onto the main discharge tray 21 until the succeeding sheet P is discharged may be provided in the second embodiment. Then, even if the main discharge tray 21 is lowered only a short distance and the upward curl of the trailing end of the discharged sheet P is likely to interfere with the succeeding sheet P, the interference of the already discharged preceding sheet P with the succeeding sheet P can be securely avoided since the trailing end of the sheet P discharged onto the main discharge tray 21 is pressed by the sheet pressing member 50 until the succeeding sheet P is discharged.

In both first and second embodiments, the sheet sensor 44 is provided to detect the leading end and the trailing end of the sheet P about to be discharged onto the main discharge tray 21, and the control unit 40 executes its controls in accordance with the detection signals from the sheet sensor 44. Thus, the sheet P about to be discharged onto the main discharge tray 21 has the leading end and the trailing end thereof detected by the sheet sensor 44. Accordingly, the elevation control of the main discharge tray 21 can be easily executed by the control unit 40 by utilizing such detection results.

The present invention is not limited to the foregoing embodiment and embraces the following contents.

Although the image forming apparatus 19 is adopted as the upstream apparatus disposed upstream of the sheet post-processing apparatus 10 in the foregoing embodiment, the upstream apparatus is not limited to the image forming apparatus 19 and may be one of various types of sheet handling apparatuses including ordinary printing machines and sorting machines for sorting sheets according to the present invention.

In the foregoing embodiment, the sheet sensor 44 is disposed in the vicinity of the sheet discharge opening 112 of the apparatus main body 11, and the control unit 40 carries out the elevation control of the main discharge tray 21 in accordance with the detection results of the sheet sensor 44. Instead, an operation starting timing of the photosensitive drum or the fixing device 192 in the image forming apparatus 19 may be, for example, detected, and the elevation control of the main discharge tray 21 is carried out while measuring a time from this operation starting timing by means of a timer.

Although the elevation control of the main discharge tray 21 is described in the foregoing embodiment, such a control is not limitedly applicable to the main discharge tray 21, but is similarly applicable to the auxiliary discharge trays 22.

Although an optical sensor is adopted as the sheet sensor 44 for detecting the leading end and the trailing end of the sheet P in the foregoing embodiment, the sheet sensor 44 is not limited to an optical sensor and another system such as the one for detecting the presence or absence of the sheet by a movement of a striker may be adopted according to the present invention.

In the foregoing embodiment is adopted the system using the timing belt 34 as the elevating mechanism 30. Instead, the discharge trays 20 may, for example, be attached to a vertically extending spiral rod and this spiral rod may be rotated in forward and backward direction about its center axis by means of a drive motor to move the discharge trays 20 upward and downward.

In the foregoing embodiment, whether the curl of the sheet P is an upward curl or a downward curl is discriminated by the curl discriminating section 411 based on the kind of the sheet P entered with the image forming condition entering section 196 of the image forming apparatus 19 and the information as to whether or not duplex printing is applied to the sheet P. Instead, the curled state may be directly detected from the sheet P being conveyed along a specified conveyance path.

In the foregoing embodiment, the vertical position of the main discharge tray 21 is recognized through the time measurement by means of the timer provided in the control unit 40. Instead, a height sensor for detecting the height of the main discharge tray 21 may be provided in the vicinity of the main discharge tray 21, and the position of the main discharge tray 21 may be controlled in accordance with a detection signal from this height sensor.

Although the home position H1, the upper position H2 and the lower position H3 are set as invariable positions in the foregoing embodiment, they may be, instead, made variable depending on the thickness of the bundle of the discharged sheets P.

In the foregoing embodiment, the elevation control of the first embodiment for moving the height position of the main discharge tray 21 upward and downward between the home position H1 and the upper position H2 is carried out for the downward curled sheets P, whereas the elevation control of the second embodiment for moving the height position of the main discharge tray 21 upward and downward between the upper position H2 above the home position H1 and the lower position H3 below the home position H1 is carried out for the upward curled sheets P. However, the present invention is not limited to such controls in conformity with the types of the curls, and the control of the first embodiment may be adopted for the upward curled sheets P while the control of the second embodiment may be adopted to the downward curled sheets.

This application is based on patent application No. 2005-001000 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet post-processing apparatus for applying a specified post-processing to sheets successively received from an upstream apparatus into an apparatus main body, comprising:

a discharge tray onto which the sheets having passed through the apparatus main body are discharged, the discharge tray being movable upward and downward between a specified home position, an upper position located above the home position, and a lower position located below the home position, an elevating mechanism for moving the discharge tray upward and downward, a position sensor disposed for detecting a leading end and a trailing end of a sheet about to be discharged onto the discharge tray, and a control unit operatively connected to the elevating mechanism and the position sensor for controlling upward and downward movements of the elevating mechanism in synchronism with the sheet discharge onto the discharge tray, wherein the discharge tray is caused to move from the home position to the upper position in synchronism with an arrival timing of the leading end of a first sheet being discharged at the discharge tray, the discharge tray is caused to move from the upper position to the lower position in synchronism with an arrival timing of the leading end of a succeeding sheet at the discharge tray, and the discharge tray is caused to receive the succeeding sheet while being caused to move from the lower position to the upper position, during the discharge of the succeeding sheet onto the discharge tray.

2. A sheet post-processing apparatus according to claim 1, further comprising a sheet pressing member for pressing the trailing end of the sheet discharged onto the discharge tray, the sheet pressing member being operable to press the sheet when the discharge tray is located at the upper position while being operable to release the pressing on the sheet when the discharge tray is located at the lower position.

3. A sheet post-processing apparatus according to claim 1, wherein the upstream apparatus is an image forming apparatus for forming a specified image on the sheet.

4. A sheet post-processing apparatus for applying a specified post-processing to sheets successively received from an upstream apparatus into an apparatus main body, comprising:

a discharge tray onto which the sheets having passed through the apparatus main body are discharged, the discharge tray being movable upward and downward between a specified home position, an upper position located above the home position, and a lower position located below the home position, an elevating mechanism for moving the discharge tray upward and downward, a position sensor disposed for detecting a leading end and a trailing end of a sheet about to be discharged onto the discharge tray, a curl discriminating section for discriminating whether the sheet fed from the upstream apparatus is downwardly curled or upwardly curled, and a control unit operatively connected to the elevating mechanism and the position sensor for controlling upward and downward movements of the elevating mechanism in synchronism with the sheet discharge onto the discharge tray, wherein, when the curl discriminating section discriminates that the sheet is downwardly curled, the discharge tray is caused to move from the home position to the upper position in synchronism with an arrival timing of the leading end of the sheet being discharged at the discharge tray while being caused to return to the home position in synchronism with an arrival timing of the trailing end of the discharged sheet at the discharge tray, when the curl discriminating section discriminates that the sheet is upwardly curled, the discharge tray is caused to moved from the home position to the upper position in synchronism with an arrival timing of the leading end of a first sheet being discharged at the discharge tray, the discharge tray is caused to move from the upper position to the lower position in synchronism with an arrival timing of the leading end of a succeeding sheet at the discharge tray, and the discharge tray is caused to receive the succeeding sheet while being moved from the lower position to the upper position during the discharge of the succeeding sheet onto the discharge tray.

5. A sheet post-processing apparatus according to claim 4, further comprising a sheet pressing member for pressing the trailing end of the sheet discharged onto the discharge tray, the sheet pressing member is operable to press the sheet when the discharge tray is located at the upper position, while being operable to release the pressing on the sheet when the discharge tray is located at the lower position.

6. A sheet post-processing apparatus according to claim 5, wherein the upstream apparatus is an image forming apparatus for forming a specified image on the sheet.

7. A sheet post-processing apparatus according to claim 4, wherein the control unit is configured and operative so that the discharge tray is caused to move from the upper position to the home position after a last sheet is discharged at the discharge tray.

8. A sheet post-processing apparatus for applying a specified post-processing to sheets successively received from an upstream apparatus into an apparatus main body, comprising:

a discharge tray onto which the sheets having passed through the apparatus main body are discharged, the discharge tray being movable upward and downward between a specified home position, an upper position located above the home position, and a lower position located below the home position, an elevating mechanism for moving the discharge tray upward and downward, and a control means for controlling the elevating mechanism to move the discharge tray upward from the home position to the upper position in synchronism with an arrival timing of a leading end of the sheet being discharged on the discharge tray, to move the discharge tray downward from the upper position to the lower position in synchronism with an arrival timing of the leading end of a succeeding sheet at the discharge tray and to receive the succeeding sheet while being caused to move from the lower position to the upper position during the discharge of the succeeding sheet onto the discharge tray.

9. A sheet post-processing apparatus according to claim 8, further comprising a sheet pressing member for pressing the trailing end of the sheet discharged onto the discharge tray, the sheet pressing member being operable to press the sheet when the discharge tray is located at the upper position while being operable to release the pressing on the sheet when the discharge tray is located at the lower position.

10. A sheet post-processing apparatus according to claim 8, wherein the upstream apparatus is an image forming apparatus for forming a specified image on the sheet.

* * * * *